United States Patent [19]

Saucier

[11] 4,180,942

[45] Jan. 1, 1980

[54] WINDOW INSULATION

[76] Inventor: Ernest Saucier, 143 Merriam Ave., Leominster, Mass. 01543

[21] Appl. No.: 929,672

[22] Filed: Jul. 31, 1978

[51] Int. Cl.[2] ..... E05D 15/26

[52] U.S. Cl. ..... 49/125; 49/63; 49/416; 49/417; 49/419; 49/458

[58] Field of Search ..... 49/63, 61, 125, 406, 49/458, 419, 417, 416, 422, 423

[56] References Cited

U.S. PATENT DOCUMENTS

| | | | |
|---|---|---|---|
| 1,086,319 | 2/1914 | Forsyth | 49/63 X |
| 1,751,358 | 3/1930 | Rice et al. | 49/125 X |
| 2,108,000 | 2/1938 | Holt et al. | 49/406 X |
| 2,566,433 | 9/1951 | Taurman | 49/458 X |
| 2,895,182 | 7/1959 | Evans | 49/458 X |
| 2,908,051 | 10/1959 | Sparkes | 49/125 |
| 3,065,507 | 11/1962 | Cloutier et al. | 49/63 |
| 3,228,068 | 1/1966 | Trout | 49/417 |
| 3,324,597 | 6/1967 | Rich | 49/458 X |
| 3,396,491 | 8/1968 | Giesbrecht | 49/419 X |
| 4,083,148 | 4/1978 | Saucier | 49/63 X |

*Primary Examiner*—Philip C. Kannan

*Attorney, Agent, or Firm*—Norman S. Blodgett; Gerry A. Blodgett

[57] ABSTRACT

Window insulating apparatus consisting of a plurality of low thermal conductivity panels slidably carried in a conventional window frame.

13 Claims, 4 Drawing Figures

WINDOW INSULATION

BACKGROUND OF THE INVENTION

As the years go by and the price of fuel becomes higher and higher, it becomes more important that the heat loss by convection and radiation through the windows of buildings be reduced. This is particularly true in the case of residential buildings, where there is a greater likelihood of the windows being ill-fitted and loose. In the past, it has been common practice to provide heavy, insulated drapes over large windows in homes, whereby a certain amount of radiant and convective heat loss is prevented. The ideal system is to have a dead air space between the interior and the exterior of the house in the windowspace. It has been a common but expensive practice to provide double-thickness glass in the lights of residential windows, but this still does not prevent leakage around the window and through cracks. While metal shades have the effect of reducing the radiation to and from a room (therefore preventing heat loss in the winter), they have little effect on convection loss. Various means, such as covering the interior of the window frame with a clear plastic film and cementing it in place suggest themselves, but most of these arrangements are either unsightly or are not easily removed and stored when it is desirable for aesthetic purposes and otherwise to expose the window.

These and other difficulties experienced with the prior art devices have been obviated by the apparatus disclosed in my prior U.S. Pat. No. 4,083,148 issued Apr. 11, 1978 entitled "Window Insulating Apparatus". The apparatus described in this patent consists of a plurality of panels formed of heat-insulating material arranged in side-by-side vertical planes and slidable from a side-by-side storage position at the top of the window to an operative position in which the panels are arranged in a step fashion. An extruded element is applied to the upper and lower edges of each panel, each element having a sealing surface which mates with a similar sealing surface on a similar extruded element applied to the immediately adjacent panel. A similar extruded element lies along each vertical edge of each panel, the sealing surface of each vertical extruded element engaging a similar sealing surface on an immediately-adjacent vertical extruded element.

It is a principal object of the present invention to provide an improved window insulating apparatus which has all of the advantages of the apparatus disclosed in my prior U.S. patent, supra, with improved thermal insulating properties and improved adjusting means for each of installation and compensation for wear.

Another object of this invention is the provision of improved window insulating apparatus which is simple in design, and easy to manufacture and install.

A further object of the present invention is the provision of improved window insulating apparatus comprising laminated insulating panels having superior thermal insulating properties.

It is another object of the invention to provide an optional transparent sealing means for the top window.

With these and other objects in view, as will be apparent to those skilled in the art, the invention resides in the combination of parts set forth in the specification and covered by the claims appended thereto.

SUMMARY OF THE INVENTION

In general, the present invention consists of a window insulating apparatus consisting of a plurality of panels formed of insulating material, the sum of the areas of the panels being approximately equal to that of the window opening. An extruded element is applied to the upper and lower edges of each panel, each element having a sealing surface which mates with a sealing surface on a similar extruded element applied to the immediately-adjacent panel.

More specifically, each panel is generally rectangular and arranged with its length extending horizontally across the window. The panels arranged in spaced, parallel vertical planes and are slidable vertical from a side-by-side storage position (at the top of the window) to an operative position in which the panels are distributed in a step fashion over the entire window. A plurality of spaced, parallel vertical strips of low-heat-transfer elastomeric material are mounted on the inner side surfaces of the window frame and form grooves therebetween for guiding the vertical edges of the panels. The panels are constructed of laminations of different materials which guard against convective and radiant heat loss. One such product is manufactured by The Appropriate Technology Corporation of Brattleboro, VT and consists of a sheet of nylon between two fiberfilled layers of fabric. Another is manufactured by SECO Company of Valley Forge, PA and consists of a polystyrene foam core between layers of highly reflective white pigmented polyvinyl chloride. Means is provided for adjusting the panel guiding elements in directions parallel with the transverse to the board planes of the panels. When the invention is used with a double window, consisting of an upper and lower window, a plate of transparent material is provided between the upper sash of the lower window and the bottom of the uppermost panel to provide additional insulation without sacrificing the utilitarian function of the upper window of permitting light to enter the building.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
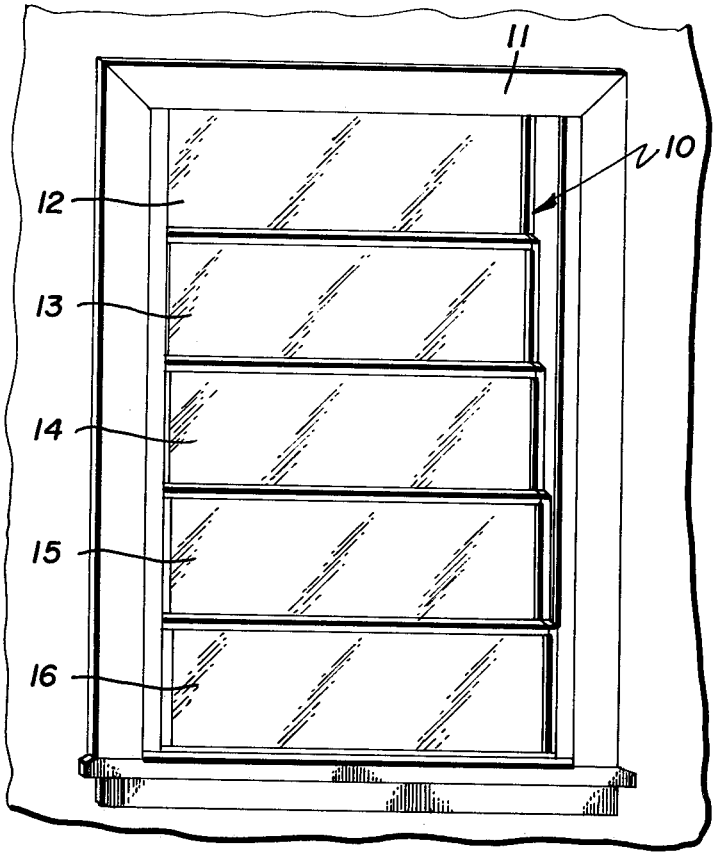
FIG. 1 is a perspective view of a window insulating apparatus embodying the principles of the present invention and shown in use with a window.
Figure 2:
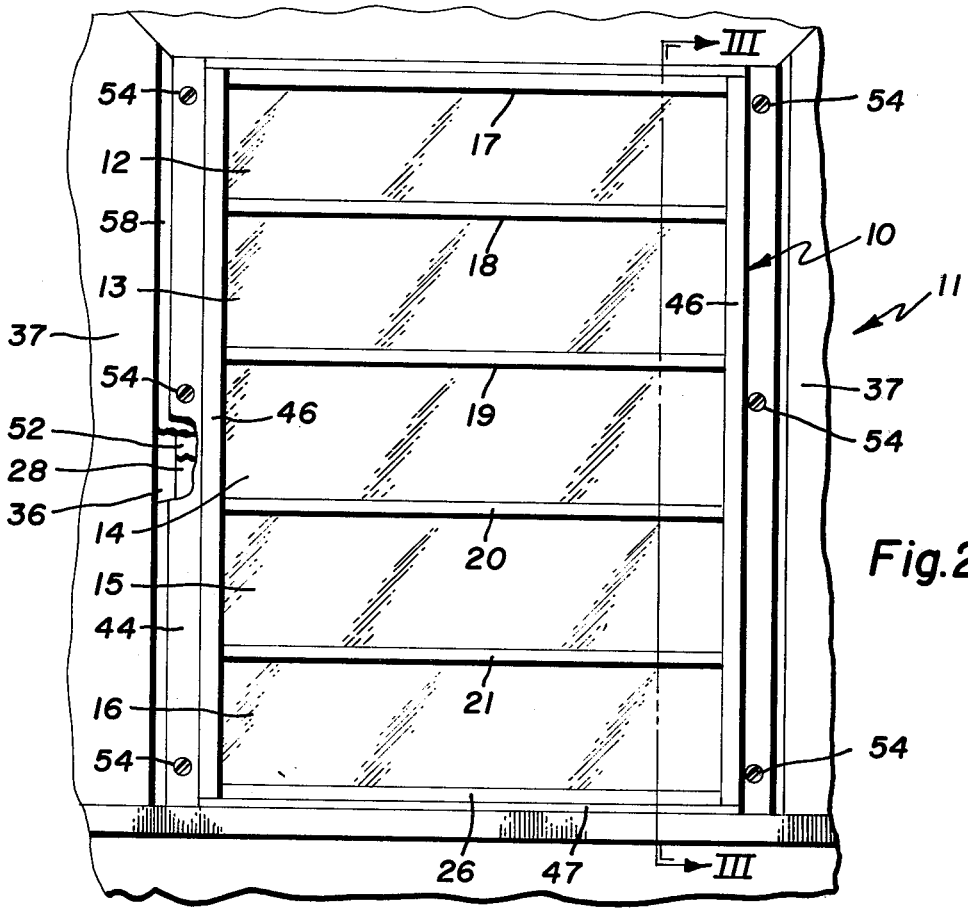
FIG. 2 is a front elevational view of the apparatus.
Figure 3:
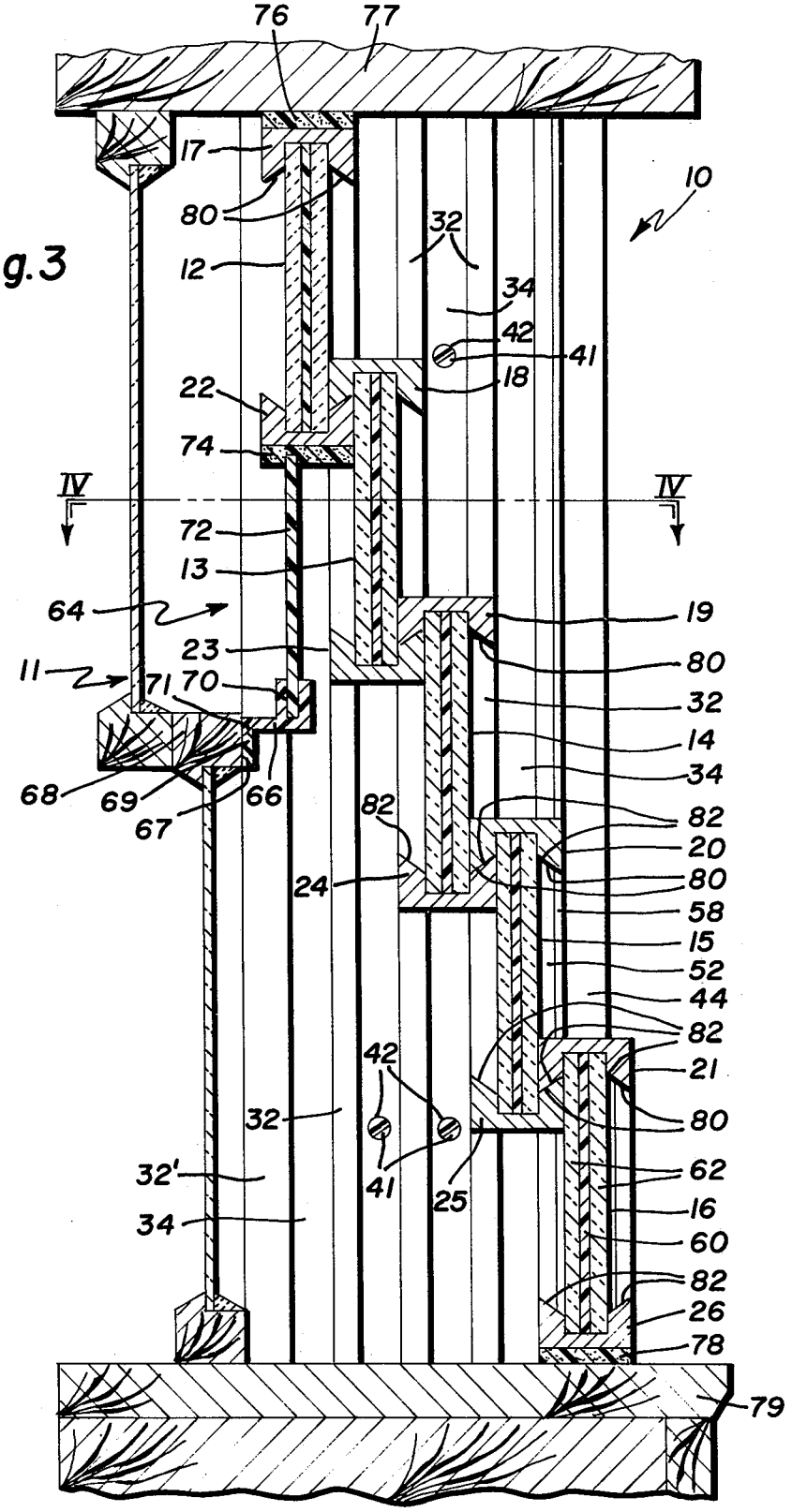
FIG. 3 is a vertical sectional view on an enlarged scale of the apparatus, taken on the line III—III of FIG. 2.

Referring first to FIGS. 1, 2, and 3, wherein are best shown the general features of the invention, the window insulating apparatus, indicated generally by the reference numeral 10, is shown in use with a conventional double-hung residential window 11. The apparatus is shown as consisting of five panels 12, 13, 14, 15, and 16, the sum of whose areas is slightly more than the total area of the window opening. Each panel is generally rectangular in shape and is arranged with its long dimension extending horizontally. The panels are arranged in side-by-side planes and are slidable vertically in the window frame from an upper storage position (where panels lie side-by-side) to a lower operative position (where the panels extend from top to bottom in a step-like condition, as shown in FIG. 3).

Referring to FIGS. 2 and 3, it can be seen that the upper and lower edges of each panel are provided with an extruded element. The upper edge of the panel 12 is provided with the extruded element 17, the upper edge of the panel 13 is provided with the extruded element 18, the upper edge of the panel 14 is provided with the extruded element 19, the upper edge of the panel 15 is provided with an extruded element 20, and the upper edge of the panel 16 is provided with an extruded element 21. The extruded elements 22, 23, 24, 25, and 26 on the lower edges of each of the panels 12, 13, 14, 15, and 16, respectively, are shown in FIG. 3.

The inner sides of a pair of side frame members 28 of the casing are provided with spaced vertical grooves 30. One side frame member 28 is shown in detail in FIG. 4, the opposite member 28 being identical in every respect but of opposite hand. Vertical guide strips 32, rectangular in cross section, are located within grooves 30 and extend beyond the inside surface of side frame member 28 to form vertical grooves 34 therebetween. Strips 32 are preferably held in place by means of adhesive and are constructed of a low-heat-transfer elastomeric material, preferably of foamed plastic having the general properties of felt.

Figure 4:
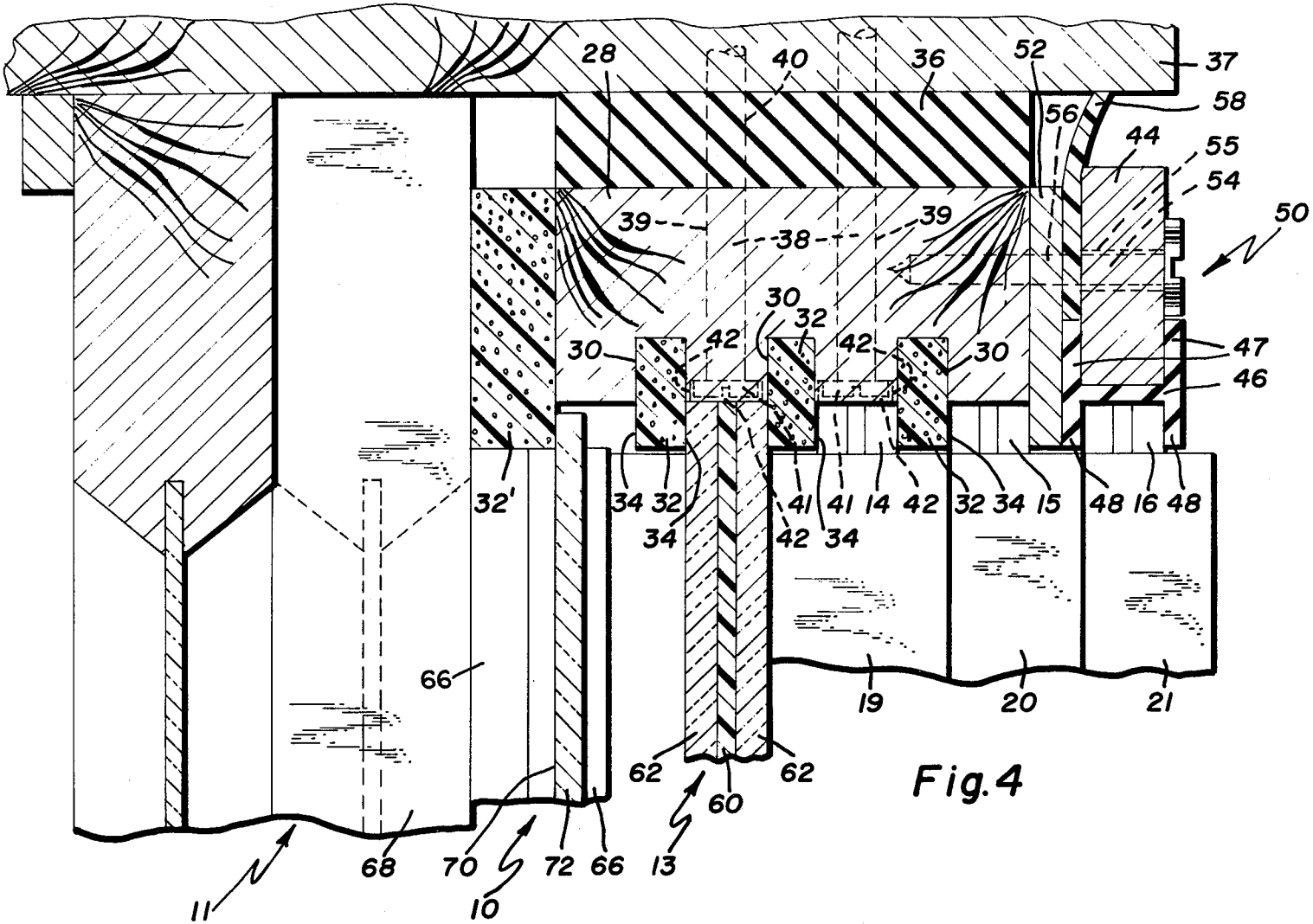
FIG. 4 is a horizontal sectional view of a portion of the invention taken on the line IV—IV of FIG. 3.

As shown in FIG. 4, the vertical ends of the panels 12–16 are guided for vertical movement within the grooves 34 and form with the strips 32 a continuous vertical wall of low heat-transfer material across the window space when the panels are in the closed position as shown in FIG. 3.

The innermost guide strip 32' extends along the inner side of side frame member 28 between the side frame member and the windows and is constructed of a material similar to that of strips 32.

Side frame members 28 are movably mounted toward and away from each other. The relative position of each side frame member is determined by first adjusting means comprising a layer of elastomeric material 36 such as rubber or foamed plastic extending between the side frame member and the adjacent vertical window casing member 37, and screws 38. The shanks of the screws 38 extend freely through bores 39 and 40 in side frame member 28 and the layer of elastomeric material 36, respectively, and are threaded into the vertical casing member 37. The heads of the screws, indicated at 41, are larger than bores 39 and extend into countersunk portions 42 of bores 39. During installation of the window insulating apparatus, the screws 38 are threaded into side casing member 37, thereby drawing side frame member 28 toward the casing member and compressing the layer of elastomeric material 36. After the panels are positioned within grooves 34, screws 38 are backed off until the side frame member 28 is positioned so as to produce the desired sliding characteristics between the panel elements and guiding elements of the frame member. The screws 38 can be backed off additional amounts to compensate for wear of the various sliding components during subsequent use of the window insulating apparatus.

As shown in FIG. 4, the guiding elements for the outermost panel 16 comprise on each side thereof a vertically-extending guide rail 44 and a plastic extrusion strip 46 fastened to the vertical edge of the outermost panel 16 and slidably mounted on guide rail 44. Extrusion member 46 is H-shaped in horizontal cross-section and comprises pairs of oppositely-directed vertical flanges 47 and 48 for straddling rail 44 and panel 16, respectively.

Each rail 44 is adjustably mounted by a second adjusting means generally indicated by the reference numeral 50, which comprises a spacer element 52 extending vertically between the rail 44 and the forward side of the side frame member 28 and adjusting screws 54, the shanks of which extend freely through apertures 55 and 56 in rail 44 and the layer 52, respectively, and are threaded into the side frame member 28. The outer members of the flanges 47 and 48 are in frictional contact with layer 52 and the amount of friction can be varied by tightening or loosening the adjusting screws 54. The remaining space between layer 52 and rail 44 not occupied by the flanges of member 46 is filled by a plastic strip 58 extending out to the vertical casing member 37. Element 46 and strip 58 are preferably made of flexible vinyl plastic material and layer 52 is preferably made of the same material as strips 32. Strip 58 is made wide enough to extend beyond the vertical window casing 37 or to fold inward toward the casing 37 as shown in FIG. 4, depending on the depth of the casing. Apertures 55 in guide rail 44 are greatly oversized to allow for additional adjustment of the rail toward and away from the edge of the front panel 16 independently of side frame member 28. In this way, the front panel 16 can always be maintained in a tight sliding relationship with its associated guide elements, so that the entire panel assembly can be maintained in the upper closed position when it is desired to do so regarless of the looseness between the remaining panels and their associated guiding elements as a result of subsequent wear. In addition, the guiding elements for the front panel function as a locating point for the entire panel structure allowing the window insulating apparatus to be properly located and to function properly, regardless of size variations of the various components due to normal manufacturing tolerances.

The panels 12–16 are laminated structures, see panel 13 in FIG. 4, comprising a central relatively rigid layer 60 and two outer layers 62. The central layer 60 is preferably made of plastic material coated on at least one side with a radiant heat-reflective material. The two outer layers 62 are preferably made of relatively soft low thermal conductive material, as for example, plastic foam having the same felt-like characteristics as guide strips 32. In this way, the panels provide protection against heat loss in the form of both convection heat and radiant heat.

Referring particularly to FIG. 3, there is shown an optional feature for providing additional insulation to the upper portion of window 11 and is generally indicated by the reference numeral 64. Optional feature 64 comprises a removable bracket 66 mounted to a stationary bracket 67 fixed to the upper sash 68 of the lower window. Bracket 66 extends rearwardly below the upper rear panel 12 and includes a horizontal groove 70 facing the bottom of panel 12. Bracket 66 has a downwardly extending lip 69 fits into a groove 71 in bracket 67. Bracket 66 will thereby be held in place on bracket 67 provided there is sufficient downward pressure on bracket 66. A plate 72 of transparent material is mounted in groove 70 and extends upwardly into a layer of elastomeric material 74 attached to the lower extruded element 22 of panel 12. Layer 74 is preferably constructed of a soft plastic foam material. Plate 72 may be made of glass or rigid clear plastic material. It is preferred that bracket 66 to be made of a flexible plastic material to enable plate 72 to be snapped into and out of position as desired. Transparent plate 72 extends between side frame members 28 within the rearmost grooves 34 with a slight clearance between the plate and the side frame members 28.

An elastomeric plastic foam pad 76 is mounted on the underside of the top casing member 77 for engagement with the upper extruded element 17 of the upper rear panel 12 and a similar elastomeric plastic foam element 78 is mounted on the lower window sill 79 for engagement with the lower extruded element 26 of the forward panel 16 when the panels are in the closed position as shown in FIG. 3.

Extruded elements 17–21 are provided with inclined lower surfaces 80 which engage upper inclined surfaces of the lower extruded elements 22–26 to interlock the panels 12–16, as shown in FIG. 3 when the panels are extended to their fully closed position. However, there is a slight clearance between each extruded element and the adjacent panel.

The operation of the invention will now be readily understood in view of the above description. In the drawings, the panels are shown as in their operative position in which the passage of heat outwardly through the window is inhibited. In this position, as is evident in FIGS. 1 and 2, the panels 12, 13, 14, 15, and 16 completely cover the window opening. When the weather is such that the heat saving features is not needed, the panels are moved up into vertical position coextensive with the panel 12 (which never moves), so that four-fifths of the window is available for the admission of light, the five panels occupying only the upper one-fifth.

As is evident in FIG. 3, when the panels are moved to their downward position, the sealing surfaces are in firm engagement. The sealing surface of the upper horizontal extruded element of the lower panel tightly engages the sealing surface of the lower extruded element of the upper panel. The first and second adjusting means maintain the panels snugly pressed against the side frame members guiding elements along the sides of the panels.

The advantages of the present invention can be readily understood in view of the above description. The present invention involves an attachment for conventional windows which can be easily applied by a homeowner, or at least applied with a minimum of labor by the employees of a business organization selling the apparatus. The device presents a pleasing appearance when in its upper stored position; most people use shades on windows and the shades are normally set at one-quarter distance at the upper part of the window in any case. In other words, it will give the appearance of a partially-drawn shade when in the storage position. When in the lower, operative position, of course, the surfaces of the panels can be decorated as appears to be necessary and even supplied with an imaginary scene of what might exist outside the window. In any case, in the operative lower position, the important criterion is the saving of heat and, particularly during the winter months, the outer appearance of the landscape is not as important as the saving heat and the expense of fuel. The size of the extruded elements and the panels on which they are fitted can, of course, be varied to suit the particular climate involved. The thickness of the insulated panel may be greater in a colder climate, but, of course, this thickness is limited by the depth of the window casing available. Furthermore, the present design lends itself very readily to sale in "kit" form in which the homeowner can cut his panels to suit his particular window size and in which the standard extruded elements can easily be cut and cemented in place. The installation of the present invention will pay for itself in a very short time. It is a positively-working shade, it reduces air draft around the lower window tracks and joints, it traps dead air for insulation purposes, and the panels provide additional insulation. Particularly, when storm windows are not closed or are loose fitting, the present invention will slow down the heat loss on colder nights. It will help to retain sunny weather heat and it acts as an indoor temperature regulator, particularly in the springtime and in fall. Also, when the apparatus is in closed or operative position, it will tend to reduce outside noise. It will lower the cost of air conditioning, not only at nighttime, but in the daytime also when in operative position, because it will reflect a degree of radiant heat from the sun. It will prevent some of the heat from entering the room and will shade the room. It is the intent of the present invention to provide a durable, adjustable construction with a minimum of friction which is intended to last for a considerable period of time and to save on the cost of heating and air conditioning in such a manner as to pay for itself in a short time. It is an attempt to approach the heat transfer coefficient, K, of an insulated exterior wall when used with storm windows and ordinary inside windows, using double-hung single glass glazing. It contemplates an installation in 10 to 15 minutes by unskilled labor and it has various built-in features for wear adjustment. The rearmost vertical guide strip contacts the lower window and allows the movement of the lower window undue wear on the inside window frame surface. The cushioned edges of the weather seal foam at the top and the bottom allow a close-fit interlock go occur between the bottom and the top edges of the panels. The guide strips at the edges of the panels provides a positive vertical tracking for all panels and allows a "light touch", even friction between the strips and panels.

It is contemplated that each guide strip 32 and spacer element 52 could be made of rigid material enclosed in a flexible vinyl sleeve having the same softness of the paneling material. The vinyl sleeve will provide protection against ultra-violet rays and moisture.

It is obvious that minor changes may be made in the form and construction of the invention without departing from the material spirit thereof. It is not, however, desired to confine the invention to the exact form herein shown and described, but it is desired to include all such as properly come within the scope claimed.

I claim:

1. Window insulating apparatus, comprising:

(a) a plurality of panels formed of low heat-transfer material, the sum of the areas of the panels being approximately equal to that of the window opening, each panel being generally rectangular and being arranged in the window opening with the length extending horizontally, the panels being arranged in side-by-side planes and slidable vertically from an upper storage position where the panels lie side-by-side to an operative position where the panels are arranged in a step-like condition, (b) an extruded element applied to the upper and lower edges of each panel, each element having a sealing surface which mates with a similar sealing surface on an extruded element applied to the immediately adjacent panel, (c) a pair of side frame members having vertically extending guiding elements for guiding the panels between the upper storage position and the lower operative position, (d) first adjusting means for moving the side frame members toward and away from each other, and (e) second adjusting means for moving the vertically extending guiding elements for the outermost panel in a direction transverse to the plane of the window to maintain the desired degree of sliding friction for the outermost panel.

2. Window insulating apparatus as recited in claim 1, wherein said first adjusting means comprises:

(a) a layer of elastomeric material between each side frame member and the adjacent vertical window casing member, and (b) a plurality of screws, the shanks of which extend freely through each side frame member and corresponding elastomeric material and are threaded into the adjacent vertical side member of the window casing for drawing the side frame member toward the adjacent window casing member while compressing the layer of elastomeric material upon advancing the screws into the side members, whereby the side member will be moved away from the adjacent window casing member by the elastomeric material upon partial withdrawing of the screws from the window casing member.

3. Window insulating apparatus as recited in claim 2, wherein the screws are countersunk set screws located between the vertically extending guiding elements on the side frame member.

4. Window insulating apparatus as recited in claim 1, wherein the guiding elements for the outermost panel comprise on each side thereof:

(a) a vertically extending guide rail located in front of the side frame member, and (b) a vertically extending extrusion member attached to the vertical end of the outermost panel and slidingly mounted on the guide rail for vertical guiding movement.

5. Window insulating apparatus as recited in claim 4, wherein the second adjusting means comprises:

(a) a spacer element between each guide rail and corresponding side frame member, and (b) a plurality of screws, the shank of which extend freely through each guide rail and corresponding spacer element, said screw shanks being threaded into the side frame members for drawing the guide rails and extrusion members toward the spacer elements.

6. Window insulating apparatus as recited in claim 5, wherein each vertically extending extrusion member forming part of the guiding elements for the outermost panel is H-shaped in horizontal cross section for straddling adjacent vertical edges of the guide rail and outermost panel so that the guide rail is separated from the adjacent spacer element.

7. Window insulating material as recited in claim 1, wherein each panel is a lamination comprising:

(a) a central layer with at least one of its broad sides having a radiant heat reflective surface, and (b) a layer of low thermal conductive material on each side of the central layer.

8. Window insulating material as recited in claim 7, wherein the central layer is plastic.

9. Window insulating material as recited in claim 1, wherein the guiding elements for all but the outermost panel are vertical strips formed of low heat-transfer elastomeric material.

10. Window insulating apparatus as recited in claim 1, adapted for a double window consisting of an upper window and a lower window, said apparatus comprising:

(a) a supporting bracket mounted to the upper sash of the lower window and extending below the upper rear panel, and (b) a plate of transparent material supported in the bracket and extending up to the bottom of the upper rear panel and extending horizontally for the full width of the window.

11. Window insulating apparatus as recited in claim 10, wherein the transparent plate is clear plastic.

12. Window insulating apparatus as recited in claim 10, wherein the bracket has an upwardly open horizontally extending groove for supporting the lower end of the transparent plate.

13. Window insulating apparatus as recited in claim 10, wherein the bracket is formed of a flexible plastic material.

* * * * *